US011723501B2

(12) United States Patent
Reeder et al.

(10) Patent No.: US 11,723,501 B2
(45) Date of Patent: Aug. 15, 2023

(54) HANDHELD VACUUM CLEANER

(71) Applicant: MILWAUKEE ELECTRIC TOOL CORPORATION, Brookfield, WI (US)

(72) Inventors: Kyle Reeder, Waukesha, WI (US); Fraizier Reiland, Milwaukee, WI (US); Bennett W. Westling, Milwaukee, WI (US); Justin D. Dorman, Wauwatosa, WI (US); Dalton F. Hansen, Whitefish Bay, WI (US); San Sang Chan, Kowloon (HK)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 37 days.

(21) Appl. No.: 17/263,235

(22) PCT Filed: Aug. 9, 2019

(86) PCT No.: PCT/CN2019/100085

§ 371 (c)(1),
(2) Date: Jan. 26, 2021

(87) PCT Pub. No.: WO2020/030149

PCT Pub. Date: Feb. 13, 2020

(65) Prior Publication Data

US 2021/0153706 A1 May 27, 2021

Related U.S. Application Data

(60) Provisional application No. 62/823,793, filed on Mar. 26, 2019, provisional application No. 62/716,700, filed on Aug. 9, 2018.

(51) Int. Cl.
*A47L 9/16* (2006.01)
*A47L 5/26* (2006.01)
(Continued)

(52) U.S. Cl.
CPC ..... *A47L 9/1608* (2013.01); *A47L 5/26* (2013.01); *A47L 9/1666* (2013.01);
(Continued)

(58) Field of Classification Search
CPC .... A47L 9/1608; A47L 9/1666; A47L 9/1683; A47L 9/22; A47L 9/2884; A47L 9/322;
(Continued)

(56) References Cited

U.S. PATENT DOCUMENTS 3,320,727 A 5/1967 Farley et al.
5,105,505 A * 4/1992 Reed, Jr. ..... A47L 5/26 15/350

(Continued)

FOREIGN PATENT DOCUMENTS

CN 1911151 A 2/2007
CN 101023850 A 8/2007

(Continued)

OTHER PUBLICATIONS

International Search Report and Written Opinion for Application No. PCT/CN2019/100085 dated Oct. 28, 2019 (9 pages).

(Continued)

*Primary Examiner* — Anne M Kozak
*Assistant Examiner* — Christopher Soto
(74) *Attorney, Agent, or Firm* — Michael Best & Friedrich LLP

(57) ABSTRACT

The handheld vacuum cleaner (10) includes a housing (22), a handle (42), a suction opening (90), and a debris separator (14). The debris separator (14) includes a generally horizontal cyclone (66). An airflow rotate about a cyclone axis (70) to separate debris from the airflow. The cyclone axis (70) being generally perpendicular to an inlet axis (222). A suction source (170) is operable to generate the airflow. The suction source (170) including a suction source axis (186), (Continued)

a motor (178), and a fan (182) rotated by the motor (178) about the suction source axis (186). The suction source axis (186) is positioned at an obtuse angle relative to the inlet axis (222) and perpendicular to the cyclone axis (70). A debris collector (18) is in fluid communication with the debris outlet (126). The debris collector (18) is configured to receive the debris separated from the airflow. The debris collector (18) extends below the suction source (170).

20 Claims, 8 Drawing Sheets

(51) Int. Cl.
*A47L 9/22* (2006.01)
*A47L 9/28* (2006.01)
*A47L 9/32* (2006.01)

(52) U.S. Cl.
CPC ..... *A47L 9/1683* (2013.01); *A47L 9/22* (2013.01); *A47L 9/2884* (2013.01); *A47L 9/322* (2013.01)

(58) Field of Classification Search
CPC ..... A47L 9/1691; A47L 9/127; A47L 9/12; A47L 9/1463; A47L 9/1633; A47L 9/165; A47L 9/20; A47L 5/26
See application file for complete search history.

(56) References Cited

U.S. PATENT DOCUMENTS 5,452,490 A 8/1995 Brundula et al.
6,026,539 A 2/2000 Mouw et al.
6,228,260 B1 5/2001 Conrad et al.
6,571,422 B1 6/2003 Gordon et al.
6,968,593 B1 * 11/2005 Lenkiewicz ..... A47L 7/0009 15/384
6,974,488 B2 12/2005 Dyson
7,303,613 B2 12/2007 Rosenzweig
7,941,895 B2 5/2011 Conrad
7,998,260 B2 8/2011 Ni
8,034,140 B2 10/2011 Conrad
8,117,712 B2 * 2/2012 Dyson ..... A47L 9/2894 15/327.2
8,146,201 B2 4/2012 Conrad
8,152,877 B2 4/2012 Greene
8,176,597 B2 * 5/2012 Stein ..... A47L 9/1658 55/424
8,302,250 B2 11/2012 Dyson et al.
8,347,455 B2 1/2013 Dyson et al.
8,578,555 B2 11/2013 Conrad
8,869,344 B2 10/2014 Conrad
9,066,643 B2 6/2015 Conrad
9,078,549 B2 7/2015 Conrad
9,084,523 B2 7/2015 Conrad
9,084,524 B2 7/2015 Conrad
9,095,245 B2 8/2015 Conrad
9,119,511 B2 9/2015 Kah, Jr.
9,119,513 B2 9/2015 Conrad
9,420,925 B2 8/2016 Conrad et al.
9,451,853 B2 9/2016 Conrad et al.
9,585,530 B2 3/2017 Conrad et al.
9,662,964 B1 5/2017 Mirza
10,016,106 B1 7/2018 Conrad
10,092,146 B2 10/2018 Conrad
10,638,903 B2 5/2020 Nam et al.
10,646,806 B2 5/2020 Nam et al.
2002/0020154 A1 2/2002 Yang
2008/0047091 A1 2/2008 Nguyen
2009/0007369 A1 1/2009 Gomiciaga-Pereda et al.
2012/0079671 A1 4/2012 Stickney
2012/0222263 A1 * 9/2012 Conrad ..... A47L 9/1608 15/412
2013/0185892 A1 7/2013 Walker
2014/0237760 A1 * 8/2014 Conrad ..... A47L 5/24 15/344
2016/0197546 A1 7/2016 Jung
2017/0071426 A1 * 3/2017 Krebs ..... A47L 9/22
2017/0079489 A1 3/2017 Dimbylow
2017/0079490 A1 3/2017 Dimbylow
2017/0079491 A1 3/2017 Dimbylow
2017/0196421 A1 7/2017 Brown et al.
2017/0224180 A1 8/2017 Conrad et al.
2017/0280950 A1 10/2017 Nam et al.
2018/0000303 A1 1/2018 Conrad et al.
2018/0035854 A1 2/2018 Thorne
2018/0177352 A1 6/2018 Conrad
2018/0177356 A1 6/2018 Conrad
2018/0177366 A1 6/2018 Conrad

FOREIGN PATENT DOCUMENTS

CN 205458413 U 8/2016
CN 206934040 U 1/2018
CN 107788908 A 3/2018
EP 1752076 A1 * 2/2007 ..... A47L 5/24
GB 2554936 A 4/2018
JP 2004351234 A 12/2004
JP 2010252998 A1 11/2010
WO WO-2017083497 A1 * 5/2017 ..... A47L 5/24
WO 2017147643 A1 9/2017

OTHER PUBLICATIONS

Extended European Search Report for Application No. 19846465.3 dated Apr. 12, 2022 (8 pages).

* cited by examiner

HANDHELD VACUUM CLEANER

CROSS REFERENCE TO RELATED APPLICATIONS

This application is a national phase filing under 35 U.S.C. 371 of International Application No. PCT/CN2019/100085 filed Aug. 9, 2019, which claims priority to U.S. Provisional Patent Application No. 62/823,793, filed Mar. 26, 2019, and to U.S. Provisional Patent Application No. 62/716,700 filed Aug. 9, 2018, the entire contents all of which are incorporated herein by reference.

TECHNICAL FIELD

The present invention relates to vacuum cleaners, and more particularly to handheld vacuum cleaners having a cyclonic debris separator.

BACKGROUND

Vacuum cleaners may utilize one or more cyclonic separators. Each cyclonic may include communication with a debris collector. The vacuum cleaner used in particular applications varies on a number of factors. For example, handheld vacuum cleaners that are used for cleaning an office, a residence, or a worksite require a large capacity debris collector and must be arranged to allow for maneuverability. In order to increase the debris capacity of the vacuum cleaner, the debris collector size must be increased, which increases the overall size while decreasing the maneuverability of the vacuum. As a result, the arrangement of the components of the vacuum may increase the maneuverability and functionality of the vacuum.

SUMMARY OF THE INVENTION

The present invention provides in one aspect, a handheld vacuum cleaner. The handheld vacuum cleaner includes a housing, a handle extending from the housing, a suction opening including a suction inlet that extends centrally through the suction opening, a debris separator configured to separate debris from an airflow. The debris separator including an inlet having an inlet axis that extends centrally through the inlet and a debris outlet having an outlet axis that extends centrally through the outlet. The debris separator includes a generally horizontal cyclone having a cyclone axis that extends centrally through the generally horizontal cyclone. The airflow rotatable about the cyclone axis to separate the debris from the airflow. The cyclone axis being generally perpendicular to the inlet axis. A suction source operable to generate the airflow. The suction source including a suction source axis, a motor, and a fan rotated by the motor about the suction source axis. The suction source axis positioned at an obtuse angle relative to the inlet axis and perpendicular to the cyclone axis. A debris collector in fluid communication with the debris outlet. The debris collector configured to receive the debris separated from the airflow. The debris collector extending below the suction source.

Preferably, the debris separator includes a first stage separator in fluid communication with the inlet and a second stage separator in fluid communication with the first stage separator.

Preferably, the first stage separator further comprises a sidewall that extends around the cyclone axis, wherein the inlet and the debris outlet extend through and are tangential to the sidewall.

Preferably, the second stage separator includes an outer cylindrical portion having a plurality of apertures to restrict large debris from entering the second stage separator.

Preferably, the second stage separator includes a second stage debris outlet in fluid communication with the debris collector.

Preferably, the suction source axis is positioned at an acute angle relative to the outlet axis.

Preferably, the acute angle is in a range from 45 degrees to 70 degrees.

Preferably, the outlet axis is positioned at an acute angle relative to the inlet axis.

Preferably, the acute angle of the debris outlet relative to the inlet axis is in a range from 30 degrees to 60 degrees.

Preferably, the acute angle of the debris outlet relative et axis is in the range from 35 degrees to 45 degrees.

Preferably, the housing comprises a rear portion that forms a first substantially flat surface configured to support the handheld vacuum cleaner when the handheld vacuum cleaner is positioned on a surface.

Preferably, the handheld vacuum cleaner further includes a battery connection port positioned at an angle relative to the surface that is configured to receive a battery for powering the suction source, wherein the battery, when received, is proximate to and offset the surface when the handheld vacuum cleaner is positioned on the surface to allow the battery to be removably coupled to the battery connection port.

Preferably, the debris collector includes a bottom wall positioned adjacent the first substantially flat surface of the housing, wherein the bottom wall aligns with the first substantially flat of the housing to support the handheld vacuum cleaner on the surface.

Preferably, the debris collector further comprises a release trigger configured to selectively open the bottom wall to allow debris to be removed from the debris collector.

Preferably, the handheld vacuum cleaner further includes a battery connection port that extends from the housing in a position between the debris separator and a rear portion of the housing, the battery connection port being configured to receive a battery for powering the suction source.

Preferably, the handle further comprises a first portion that extends from the housing proximate the debris separator and a second portion secured to the battery connection port.

Preferably, the battery connection port is configured to receive the battery along a battery connection axis.

Preferably, the battery connection axis is offset and generally parallel to the inlet axis.

Preferably, the debris collector extends along the housing adjacent to the suction source, wherein the generally horizontal cyclone proximate a front portion of the housing and in front of the debris collector and the suction source.

Preferably, the generally horizontal cyclone is positioned above the suction source and the debris collector when the handheld vacuum cleaner is positioned on a surface.

Preferably, the handheld vacuum cleaner further includes a battery for powering the suction source.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
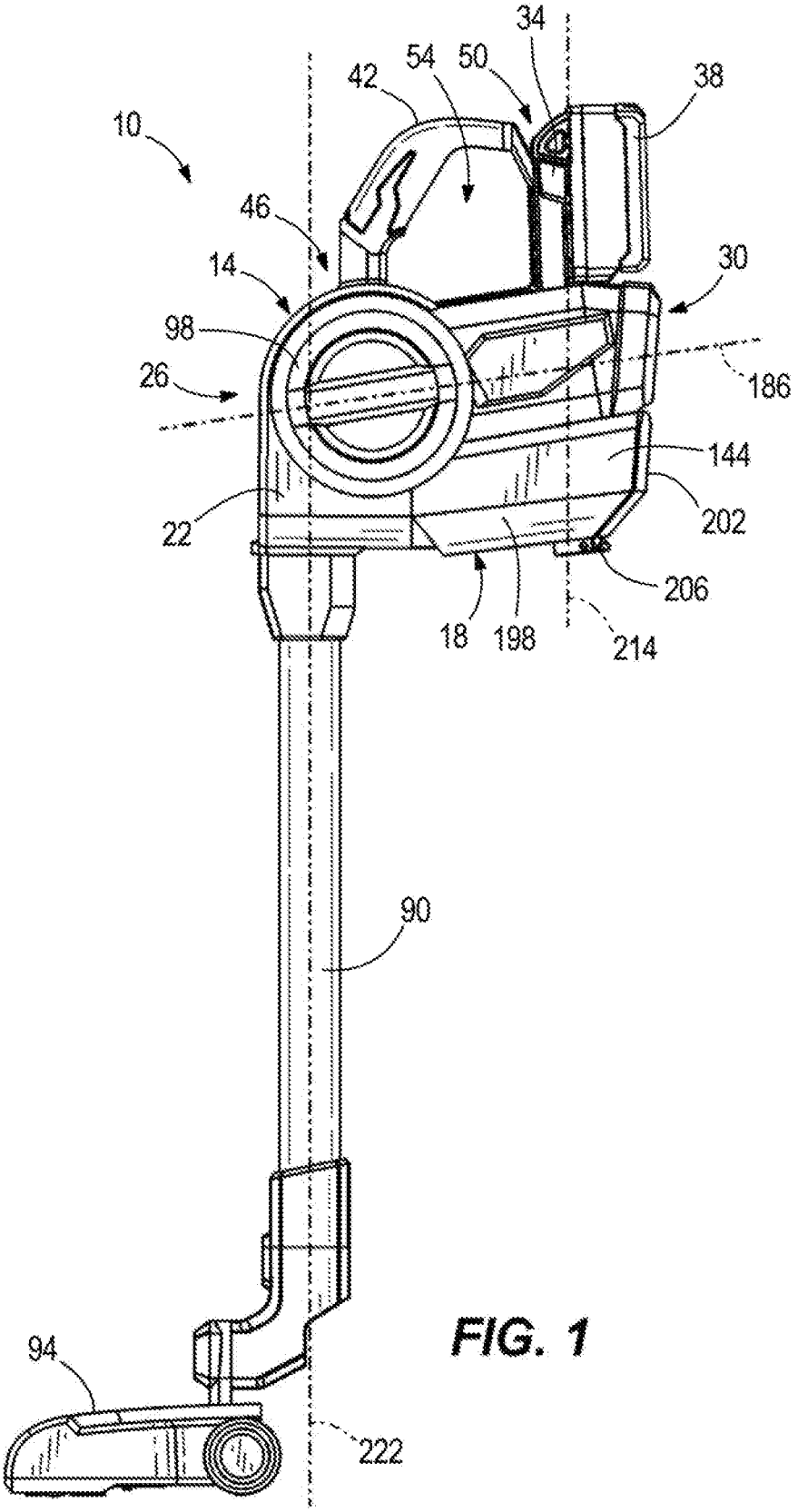
FIG. 1 is a side view of a handheld vacuum cleaner according to an embodiment of the invention.
Figure 2:
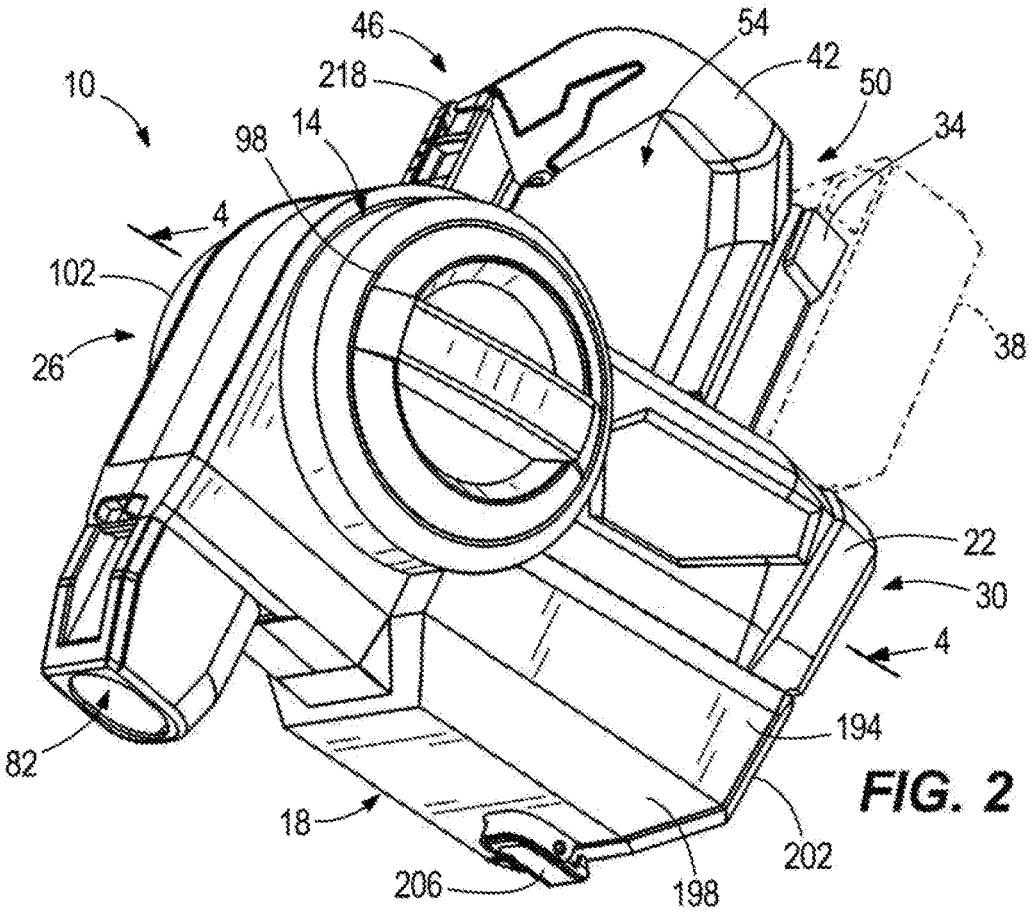
FIG. 2 is a partial perspective view of the vacuum cleaner of FIG. 1.

FIG. 1 illustrates a handheld vacuum cleaner 10. The vacuum cleaner 10 includes a debris separator 14, a debris collector 18, and a housing 22 having a front portion 26 and a rear portion 30. A battery connection port 34 extends from the housing 22 in a position between the debris separator 14 and the rear portion 30 of the housing 22. A rechargeable battery 38 is coupled to the housing 22 via the battery connection port 34. In some constructions, the battery 38 may be an onboard battery that is fixed to the battery connection port 34. In other constructions, the battery 38 may be removably coupled to the battery connection port 34. In one embodiment, the battery 38 is an 18 volt lithium-ion battery. In other embodiments, other types and voltages of batteries can be used.

The vacuum 10 further includes a handle 42. In the illustrated embodiment, a first portion 46 of the handle 42 extends from the housing 22 proximate the debris separator 14 and a second portion 50 of the handle 42 is secured to the battery connection port 34. The handle 42 forms an arcuate shape that defines a gap 54 that allows the user to grasp the handle 42 during operation of the vacuum cleaner 10. In other embodiments, the handle 42 may extend from an alternative location on the housing 22, the handle 42 may be embedded within the housing 22, and/or the like.

Figure 4:
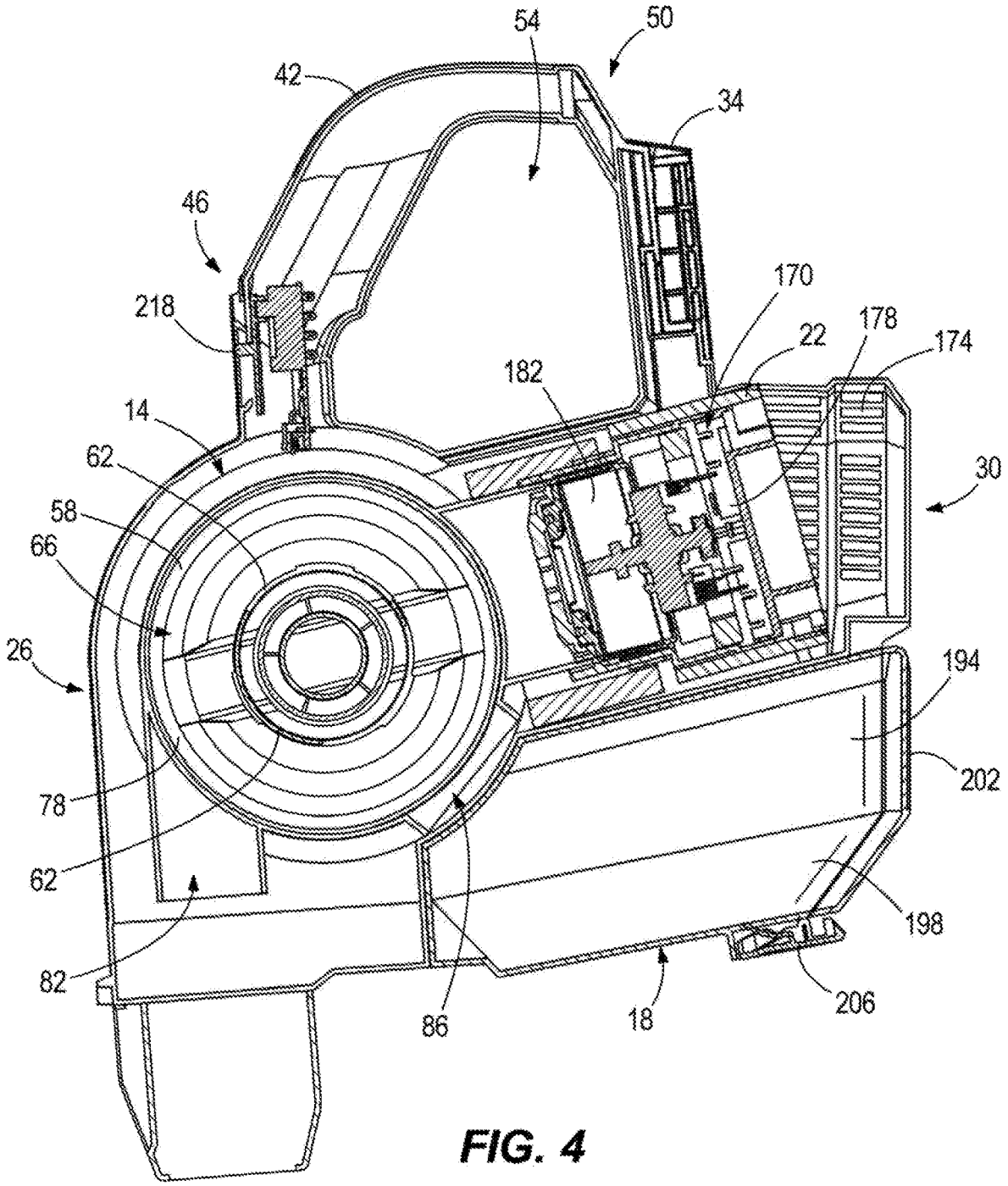
FIG. 4 is a cross-sectional about line 4-4 illustrating a generally horizontal cyclone of the vacuum cleaner of FIG. 1.

Referring to FIG. 4, the debris separator 14 is positioned within the housing 22 and separates debris from an airflow. The debris separator 14 includes a first stage cyclonic separator 58 and a second stage cyclonic separator 62 in fluid communication with the first stage separator 58. In the illustrated embodiment, the first stage cyclonic separator 58 and the second stage cyclone separator 62 of the debris separator 14 define a generally horizontal cyclone 66. More specifically, the second stage cyclone separator 68 is provided in the airflow path downstream from the first stage separator 58. As a result, the airflow passes through the first stage separator 58 and enters the second stage separator 62.

Figure 6:
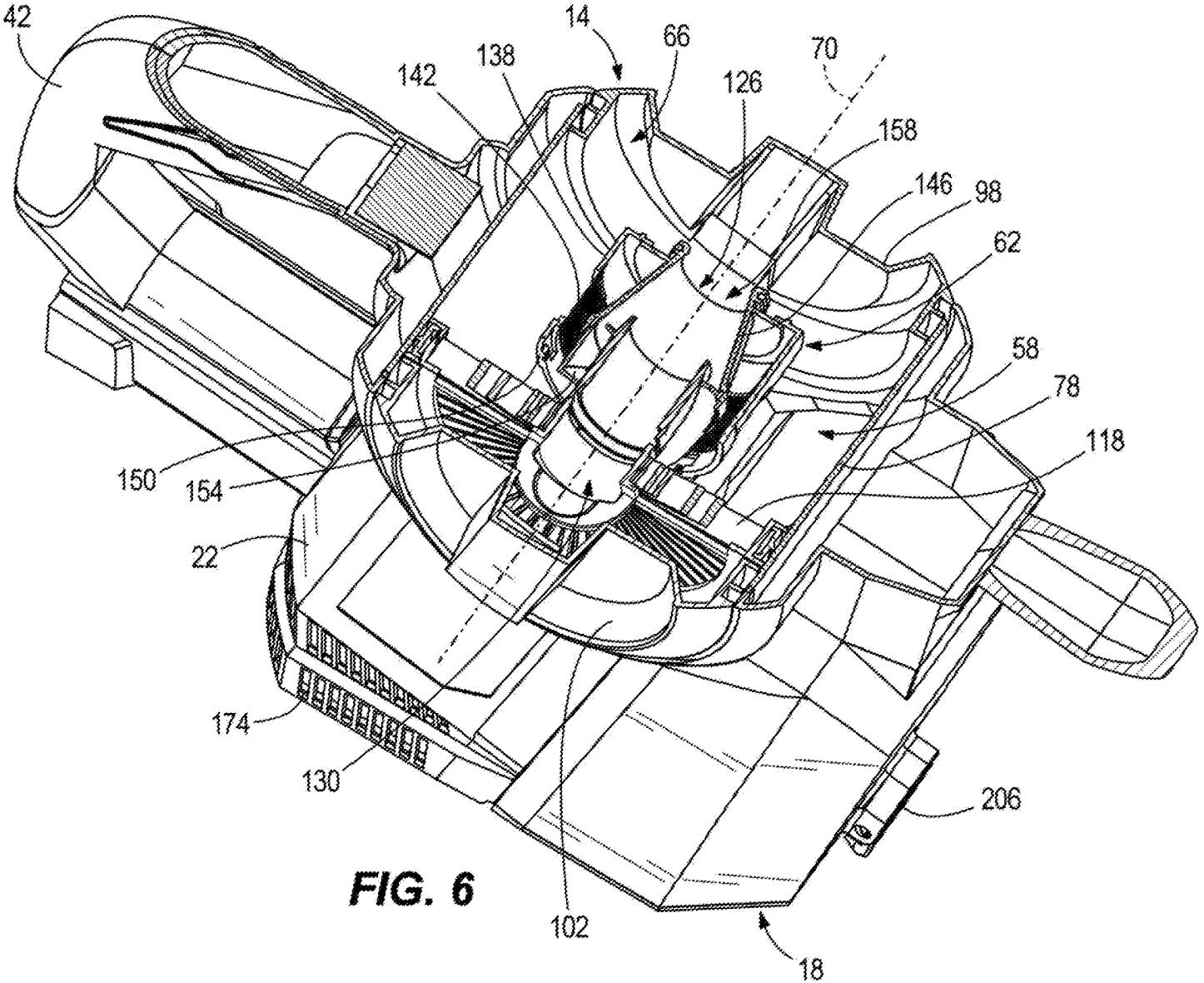
FIG. 6 is a cross-sectional view about line 6-6 illustrating the cyclonic separator of the vacuum cleaner of FIG. 1.

Referring to FIG. 6, the generally horizontal cyclone 66 includes a cyclone axis 70 that extends centrally through the generally horizontal cyclone 66. That is, if the vacuum cleaner 10 is set on a surface 74 (e.g., floor or countertop) in the orientation shown in FIG. 3, the cyclone axis 70 is horizontal relative to the surface 74 and generally parallel to the surface.

Referring to FIG. 4, the first stage separator 58 includes a sidewall 78 that extends around the cyclone axis 70. In the illustrated embodiment, the sidewall 78 is cylindrical. In other embodiments, the sidewall 78 may be frustoconical. The sidewall 78 of the debris separator 14 includes an inlet 82 and a debris outlet 86 in communication with the debris collector 18. The inlet 82 and the debris outlet 86 are generally located tangential to the sidewall 78. The inlet 82 and the debris outlet 86 extend through the sidewall 78.

The first stage separator 58 is in fluid communication with the inlet 82. With reference to FIG. 1, an extension wand or suction nozzle 90 is removably coupled to the inlet 82. Accessory tools 94 (e.g., floor nozzles, brushes, crevice tools, and the like) can be removably attached to the suction nozzle 90. The suction nozzle 90 defines a suction opening that receives debris from a desired vacuuming area. The suction opening is in communication with the inlet 82 to provide air and debris to the debris separator 14.

Figure 5A:
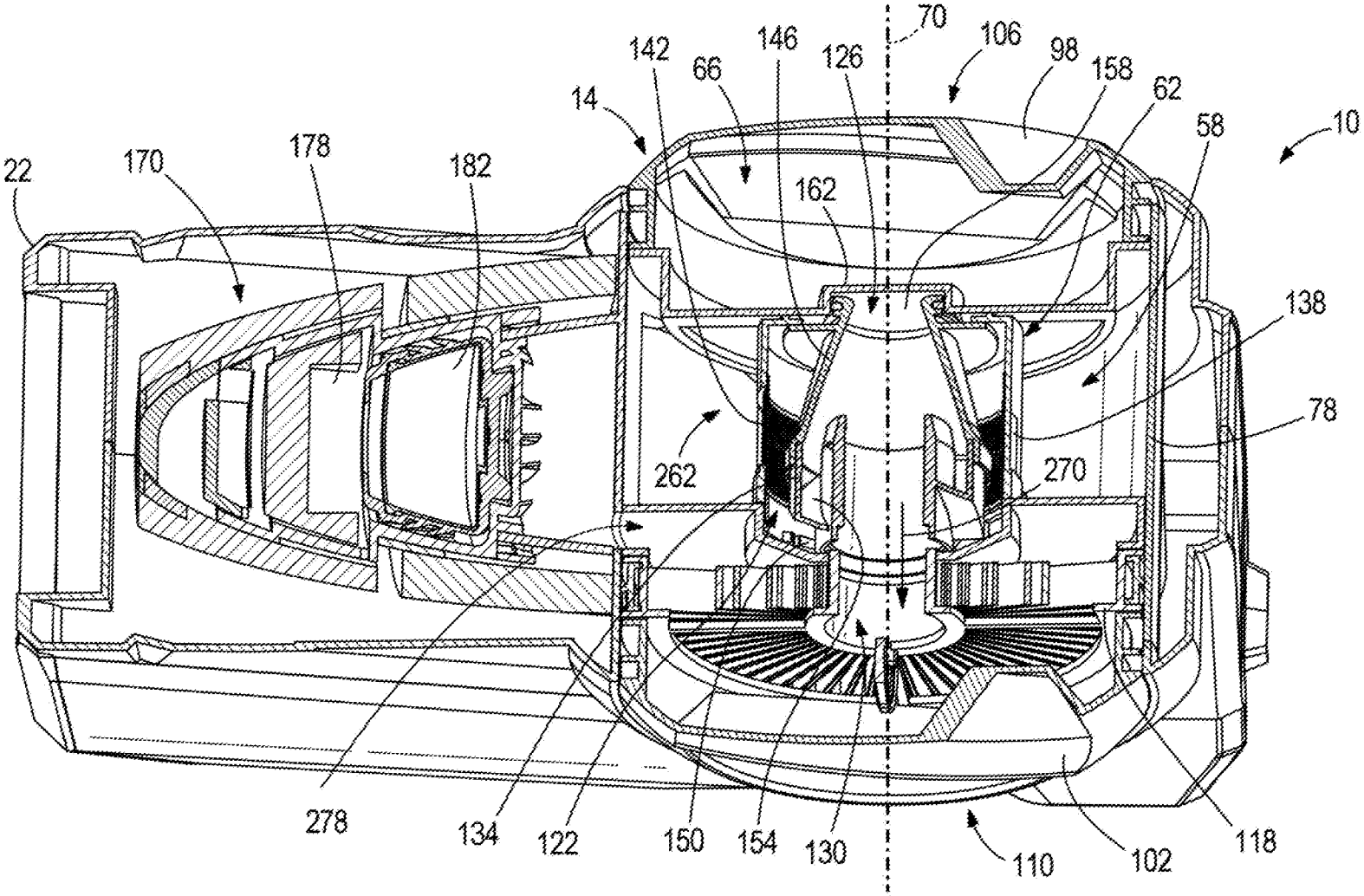
FIG. 5A is a cross-sectional view about line 5-5 illustrating second stage cyclonic separator and the suction source of the vacuum cleaner of FIG. 1.

As a result, the air and debris entering through the inlet 82 are directed along the sidewall 78 of the first stage separator 58, around the cyclone axis 70 (FIG. 5A). The debris directed along the sidewall 78 and through the outlet 86. The remaining debris and air enter the second stage separator 62 positioned downstream the first stage separator 58.

Referring to FIG. 5A, the first stage separator 58 further includes a separator cover 98 and a filter cover 102. In the illustrated embodiment, the separator cover 98 is removably coupled to a first side 106 of the housing 22 and the filter cover 102 is removably coupled to a second side 110 of the housing 22. Rotation of the separator cover 98 or the filter cover 102 about the cyclone axis 70 disengages the respective separator cover 98 or filter cover 102 from the housing 22.

The separator cover 98 is removed to access an end wall 114. The end wall 114 and the sidewall 78 defines the first stage separator 58. The end wall 114 is removably coupled to the debris separator 14 to allow for the inside of the debris separator 14 to be cleaned. In the illustrated embodiment, the end wall 114 and the separator cover 98 are perpendicular to the cyclone axis 70. In other embodiments, the separator cover 98 and/or the end wall 114 may be fastened to the housing 22 via fasteners or the like. The separator cover 98 may also be coupled to the end wall 114.

Figure 7:
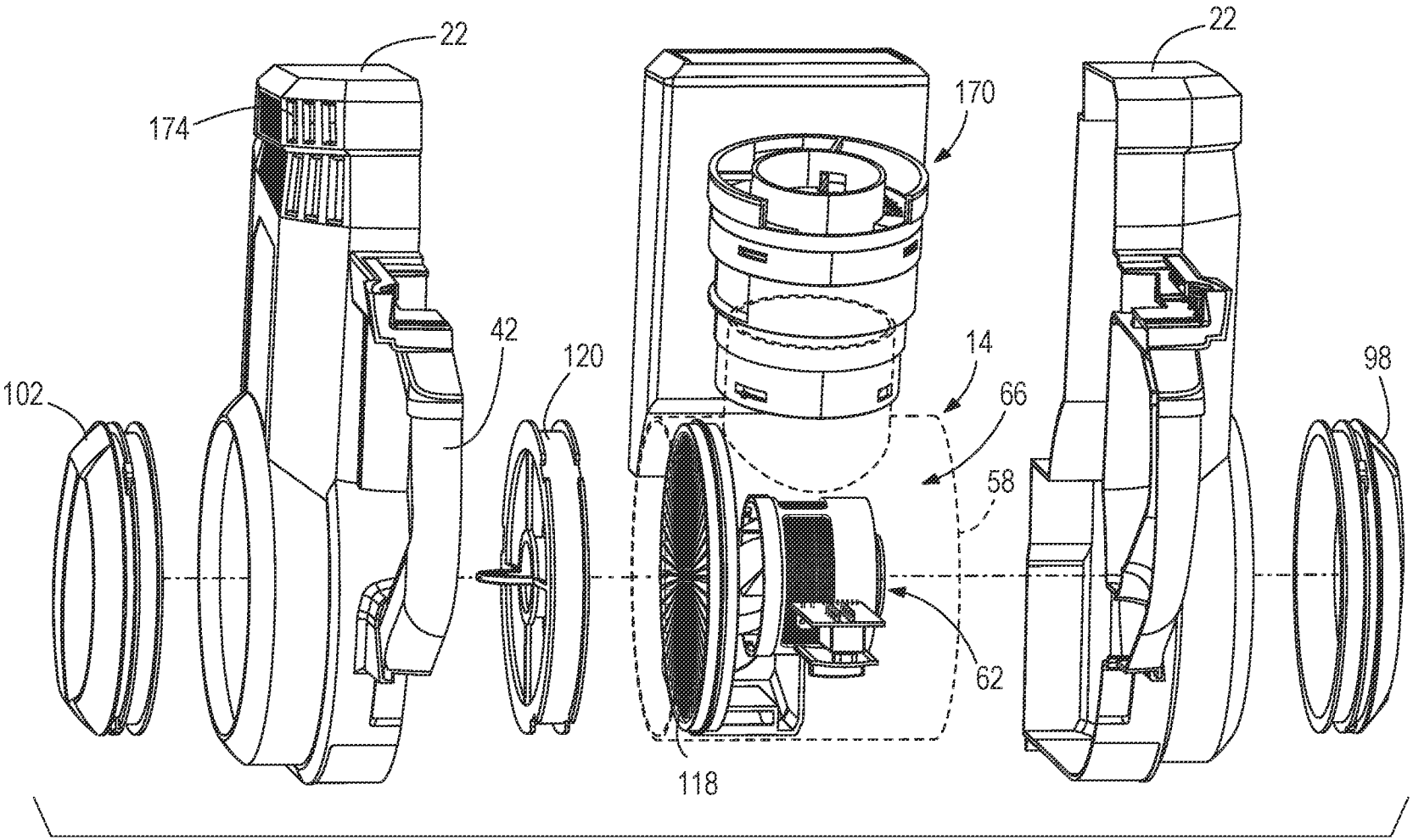
FIG. 7 is an exploded top view of the vacuum cleaner of FIG. 1.

Referring to FIG. 7, the filter cover 102 is removed to allow a filter 118 to be accessed. The filter 118 is positioned between the filter cover 102 and the first and second stage separators (58, 62). The filter 118 is positioned in a filter holder 120. The filter 118 may be removed and replaced when the filter cover 102 is removed. The filter 118 is annular and defines an aperture 121 (FIG. 5B).

Figure 5B:
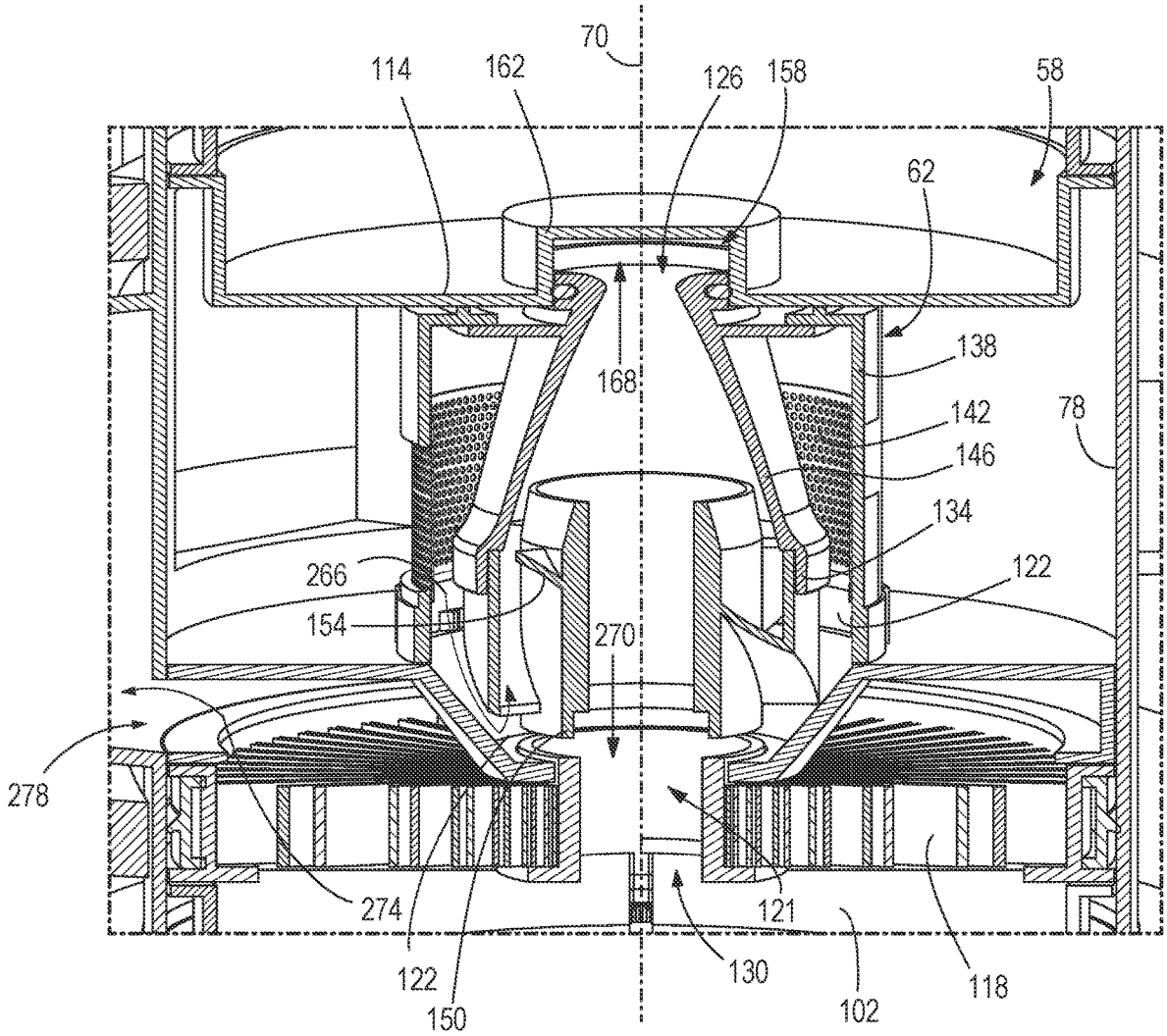
FIG. 5B is an enlarged cross-sectional side view illustrating the second stage cyclonic separator.

Referring to FIGS. 5A and 5B, the second stage separator 62 includes an inlet 122, a debris outlet (e.g., a second stage debris outlet) 126, an air outlet 130, a sidewall 134, and an outer cylindrical portion 138 having a plurality of apertures 142 to restrict large debris from entering the second stage separator 62. The air outlet 130 is in communication with the aperture 121 of the filter 118. In the illustrated embodiment, the sidewall 134 includes a frustoconical portion 146 adjacent to the debris outlet 126. The cyclone axis 70 extends centrally through the debris outlet 126 and the air outlet 130 as illustrated in FIG. 5.

The sidewall 134 surrounds the cyclone axis 70. In the illustrated embodiment, the cyclone axis 70 extends through the first stage separator 58 and the second stage separator 62. In some embodiments, an axis of the second stage separator 62 may be coaxial with an axis of the first stage separator 58. In the illustrated embodiment, the inlet 122 receives air and debris through the plurality of apertures 142 on the outer cylindrical portion 138. A wall 150 including external fins 154 extends around the air outlet 130. The wall 150 inhibits air and debris from traveling through the air outlet 130 without first traveling around the cyclone axis 70 in the second stage separator 62 to separate the debris from the airflow.

The debris outlet 126 enters into a debris cavity 158 defined by the area between the debris outlet 126 and a curved portion 162 of the end wall 114. The debris cavity 158 and the debris outlet 126 of the second stage separator 62 are in fluid communication with the debris collector 18. The debris outlet 126 and the debris cavity 158 are positioned beyond the end wall 114 of the first stage separator 58 in a direction of arrow 168 of FIG. 5*b* along the cyclone axis 70. In some embodiments, the second stage separator 62 may have a separate debris collector.

Referring to FIG. 4, the vacuum cleaner 10 further includes a suction source 170 operable to generate a suction airflow through vacuum cleaner 10 from the suction nozzle 90 through the debris separator 14 to an exhaust 174 of the suction source 170. The suction source 170 includes a motor 178 and a fan 182 that is rotated by the motor 178. The suction source 170 includes a suction source axis 186 that extends centrally through the suction source 170, the motor 178, and the fan 182 rotated by the motor 178. The motor 178 rotates the fan 182 about the suction source axis 186. The suction source 170 is in fluid communication with the debris separator 14. The suction source 170 receives filtered air from the air outlet 130 (FIG. 5A) and transfers the filtered air through the exhaust 174.

Figure 3:
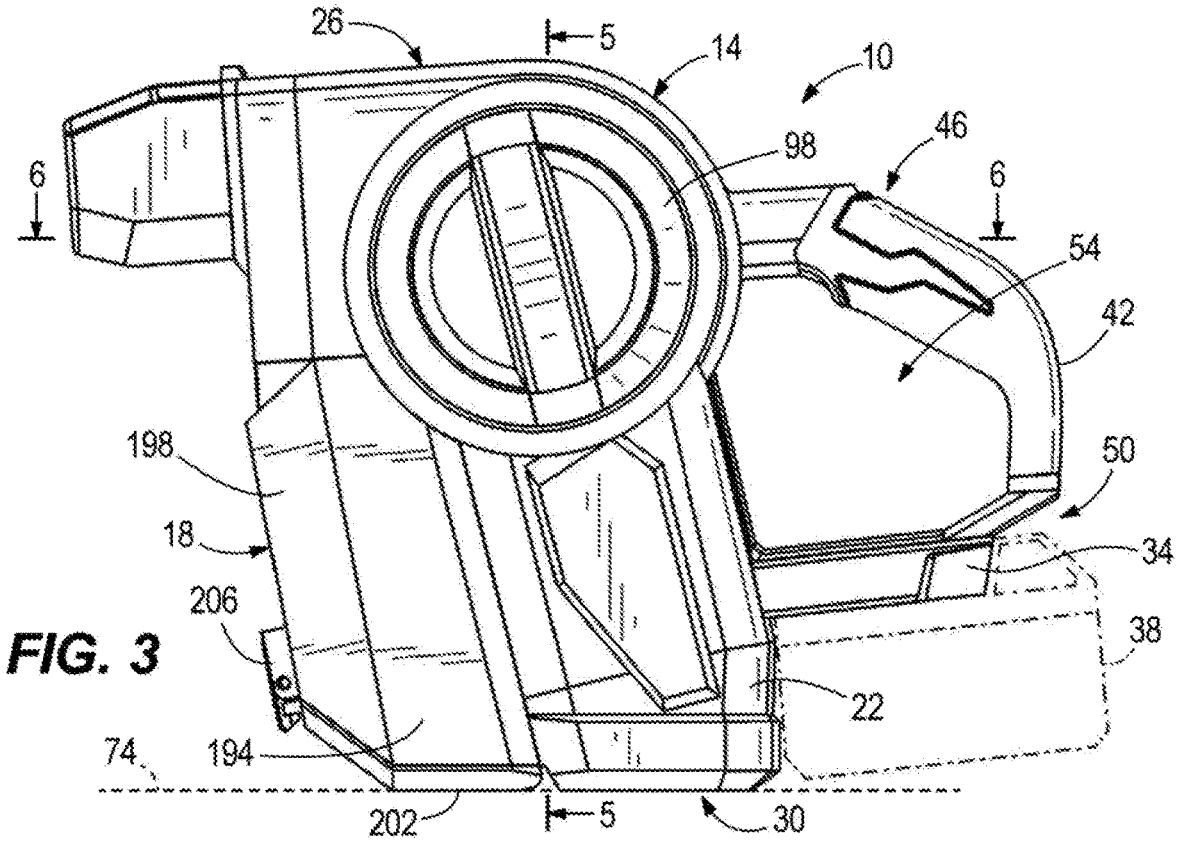
FIG. 3 is a partial side of the vacuum cleaner of FIG. 1.

Referring to FIG. 3, the debris collector 18 extends along the housing 22 adjacent to the suction source 170. Both the debris collector 18 and the suction source 170 extend from the rear portion 30 of the housing 22 to the debris separator 14 having the generally horizontal cyclone 66. Specifically, the suction source 170 and the debris collector 18 are positioned below the debris separator 14 when the vacuum is positioned on the surface 74. Referring to FIG. 1, during operation, the debris collector 18 extends below the suction source 170. The debris collector 18 spans approximately 60 percent of the width (e.g. distance between the front and rear portion 26, 30) of the housing 22. The debris separator 14 having the generally horizontal cyclone 66 is positioned adjacent the front portion 26 of the vacuum 10. That is the generally horizontal cyclone is positioned in front of the suction source 170 and the debris collector 18 when the vacuum 10 is in operation (FIG. 1). When the vacuum is positioned on a surface 74 (FIG. 3), the generally horizontal cyclone 66 is positioned above the suction source 170 and the debris collector 18.

The debris collector 18 includes a debris collector axis 190 that extends through a centrally through the debris collector. The illustrated debris collector 18 includes a first portion 194 having a generally rectangular profile that conforms with the shape of the housing 22 adjacent to the suction source 170 and a second portion 198 having a generally trapezoidal profile. The trapezoidal profile of the second portion 198 allows the users to easily grasp the debris collector 18 during removal of the debris collector. The debris collector 18 may further include a connection mechanism to removably couple the debris collector 18 to the housing 22 so the user may empty the debris collector 18. The interlock mechanism may include grooves and/or a snap fit that secures the debris collector 18 to the housing 22.

The debris collector 18 includes a bottom wall 202 and a release trigger 206 positioned proximate the bottom wall 202. The bottom wall 202 is pivotally openable to empty the debris collector 18 via actuation of the release trigger 206. Opening the bottom wall 202 empties the debris collector 18. In some embodiments, the debris collector 18 may further include a debris collector handle positioned on the debris collector to allow the user to securely grasp the collector during removal of the debris collector. The debris collector handle may extend from the debris collector or be integrally formed within the debris collector (e.g., indentations in the debris collector).

Referring to FIG. 3, the rear portion 30 of the housing 22 forms a first substantially flat surface 210 to support the vacuum 10 when the vacuum 10 is positioned on the surface 74. When the debris collector 18 is coupled to the housing 22, the bottom wall 202 is positioned adjacent to the first substantially flat surface 210 of the housing. The bottom wall 202 of the debris collector 18 aligns with the first substantially flat surface 210 of the housing 22 to further support the vacuum 10 when the vacuum 10 is positioned on the surface 74.

Referring to FIG. 1 the battery 38 is slidably attached to the battery connection port 34. The battery 38 is removed and attached to the housing 22 by moving the battery 38 along a battery connection axis 214 that extends centrally through the battery connection port 34. The battery connection axis 214 is positioned at an angle relative to the surface 74. When the battery 38 is connected and the vacuum 10 is positioned on the surface 74, the battery is proximate to and offset the surface 74 to allow the battery 38 to be removably coupled to the battery connection port 34. As a result, the battery 38 may be interchanged with an alternative battery when the vacuum is positioned on the surface 74. In some embodiments, the battery 38 may be attached to the battery connection port 34 in an alternative manner. Additionally or alternatively the connection port 34 may be positioned on or extend from an alternative location on the housing 22.

In some embodiments, the battery 26 may be configured as a battery pack including multiple battery cells. For example, the battery pack may be a 12-volt battery pack and may include three (3) Lithium-ion battery cells. In other embodiments, the battery pack may include fewer or more battery cells such that the battery pack is a 14.4-volt battery pack, an 18-volt battery pack, or the like. Additionally, or alternatively, the battery cells may have chemistries other than Lithium-ion such as, for example, Nickel Cadmium, Nickel Metal-Hydride, or the like. In some embodiments, the battery 26 may be compatible with an electric power tool and/or the like Referring to FIG. 1, a switch 218 is positioned on the handle 42 and is operably coupled to a suction source 170 (FIG. 4). In the illustrated embodiment the switch 218 is positioned on the first portion 46 of handle 42 proximate the debris separator 14. In other embodiments, the switch 218 may be positioned on any portion of the handle 42 (e.g., a bottom portion, a top portion, rear portion of the handle 42, and/or the like) to allow the user to actuate the switch 218 during operation. In the illustrated embodiment, the switch 218 is slidably movably. In other embodiments, the switch may be a press button, and/or the like.

Referring to the drawings, the illustrated vacuum 10 has an arrangement of features that has been particularly useful for some applications, including use on construction job sites. The vacuum 10 includes an arrangement of axis's that extend through components of the vacuum. Specifically, an inlet axis 222 extends centrally through the inlet 82 and centrally through the suction nozzle 90. A suction source axis 186 extends through the suction source 170. An outlet axis 226 extends centrally through the debris outlet 86. A battery connection axis 214 extends centrally through the battery connection port 34. A debris collector axis 190 extends centrally through the debris collector.

The inlet axis 222, the suction source axis 186, the outlet axis 226, the battery connection axis 214, and the debris collector axis 190 are arranged at specific angles to form a compact vacuum that is easily maneuverable by the user. When describing the relative angles between a first and a second axis, the angle is measured from the first axis to the second axis in a counter clockwise direction. For example, when the first axis is positioned at an acute angle relative to the second axis, the measurement starts at the first axis and rotates counterclockwise until the second axis is intersected.

Referring to FIG. 4, the suction source axis 186 is positioned at an angle 230 relative to the inlet axis 222. This is, the suction source axis 186 is positioned at an obtuse angle (e.g., an angle greater than 90 degrees) relative the inlet axis. In some embodiments, the suction source axis 186 is positioned at an angle in a range from approximately 90 degrees to about 140 degrees relative to the inlet axis 222. In other embodiments, the range may be from about 95 degrees to about 110 degrees. More specifically, the suction source axis 186 may be positioned at an angle of approximately 100 degrees relative to the inlet axis 222.

The outlet axis 226 is positioned at an angle 234 relative to the inlet axis 222. That is, the outlet axis 226 is positioned at an acute angle (e.g., an angle less than 90 degrees) relative to the inlet axis 222. In some embodiments, the outlet axis 226 is positioned at an angle in a range from about 2.5 degrees to about 70 degrees relative to the inlet axis 222. In other embodiments, the range may be from about 30 degrees to about 60 degrees relative to the inlet axis 222. In other embodiments, the range may be from about 35 degrees to about 45 degrees. More specifically, the outlet axis 226 may be positioned at an angle of approximately 40 degrees relative to the inlet axis 222.

The debris collector axis 190 is positioned at an angle 238 relative to the inlet axis 222. That is, the debris collector axis 190 is positioned at an obtuse angle (e.g., an angle greater than 90 degrees) relative to the inlet axis 222. In the illustrated embodiment, the debris collector axis is 190 positioned at an angle in a range from approximately 90 degrees to about 120 degrees relative to the inlet axis 222. In other embodiments, the range may be from about 95 degrees to about 110 degrees relative to the inlet axis 222. More specifically, the debris collector axis may be positioned at an angle of approximately 110 degrees relative to the inlet axis 222.

The battery connection axis 214 is offset and generally parallel the inlet axis 222. In some embodiments, the battery connection axis 214 is positioned at an angle in a range from about −10 degrees to about 10 degrees relative to the inlet axis 222. In other embodiments, the range may be from about −5 degrees to about 5 degrees.

The suction source axis 186 is positioned at an angle 242 relative to the outlet axis 226. That is, the suction source axis 186 is positioned at an acute angle (e.g., an angle less than 90 degrees) relative to the outlet axis 226. In some embodiments, the suction source axis 186 is positioned at an angle in a range from about 35 degrees to about 75 degrees relative to the inlet axis 222. In some embodiments, the range may be from about 45 degrees to about 70 degrees relative to the inlet axis 222. In some embodiments, the range may be from about 55 degrees to about 65 degrees. More specifically, the suction source axis 186 may be positioned at an angle of approximately 60 degrees relative to the outlet axis 226.

The debris collector axis 190 is positioned at an angle 246 relative to the outlet axis 226. That is, the debris collector axis 190 is positioned at an acute angle relative (e.g., an angle less than 90 degrees) to the outlet axis. In some embodiments, the debris collector axis 190 is positioned at an angle in a range from about 35 degrees to about 75 degrees relative to the outlet axis 226. In some embodiments, the range may be from about 45 degrees to about 70 degrees relative to the inlet axis 222. In some embodiments, the range may be from about 55 degrees to about 65 degrees. More specifically, the debris collector axis 190 may be positioned at an angle of approximately 60 degrees relative to the outlet axis 226.

The battery connection axis 214 is positioned at an angle 250 relative to the outlet axis 226. That is, the battery connection axis 214 is position at an obtuse angle (e.g., an angle greater than 90 degrees) relative the outlet axis. In the illustrated embodiment, the battery connection axis 214 is positioned at an angle in a range from about 90 degrees to about 180 degrees relative to the outlet axis. In some embodiments, the range may be from about 120 degrees to about 160 degrees. In some embodiments, the range may be from about 140 degrees to about 150 degrees. More specifically, the battery connection axis 214 may be positioned at an angle of approximately 145 degrees relative to the outlet axis 226.

The suction source axis 186 is offset and generally parallel to the debris collector axis 190. In some embodiments, the suction source axis is positioned at an angle in a range from about −10 degrees to about 10 degrees relative to the outlet axis. In other embodiments, the range may be from about −5 degrees to about 5 degrees.

The battery connection axis 214 is positioned at an angle 254 relative to the debris collector axis 190. That is, the battery connection axis 214 is at a generally perpendicular relative to the debris collector axis. In the illustrated embodiment, the battery connector is positioned at an angle in a range from about 70 degrees to about 120 degrees relative to the inlet axis 222. In some embodiments, the range may be from about 80 degrees to about 110 degrees relative to the inlet axis 222. In some embodiments, the range may be from about 85 degrees to about 100 degrees. More specifically, the battery connection axis 214 may be positioned at an angle of approximately 100 degrees relative to the debris collector axis 190.

The battery connection axis 214 is positioned at an angle 258 relative e suction source axis 186. That is, the battery connection axis 214 is at a generally perpendicular relative to the suction source axis 186. In the illustrated embodiment, the battery connection axis 214 is positioned at an angle in a range from about 70 degrees to about 120 degrees relative to the suction source axis 186. In some embodiments, the range may be from about 75 degrees to about 105 degrees relative to the inlet axis 222. In some embodiments, the range may be from about 80 degrees to about 95 degrees. More specifically, the battery connection axis 214 is positioned at an angle of approximately 80 degrees relative to the suction source axis 186.

In operation, the user actuates the switch 218 to operate the suction source 170 to draw a suction airflow entrained with debris through the suction nozzle 90. The airflow and debris travel through the inlet 82 of the first stage separator 58. In the illustrated embodiment, there are no bends in the flow path from the suction nozzle 90 into the first stage separator 58. The elimination of any bends in the flow path has been found particularly useful in some applications, including construction job site applications. On construction sites, the debris is relatively large (e.g., wood chips, paper, etc.). The elimination of bends in the flow path reduces the likelihood that the relatively large debris will clog the vacuum cleaner 10.

After traveling through the inlet 82, the debris and suction airflow travel around the cyclone axis 70 generally in the direction of arrows 262 of FIG. 5A. By cyclonic action, the debris is forced toward the sidewall 78 and eventually through the debris outlet 86 into the debris collector 18 (FIG. 4).

Referring to FIG. 5B, the airflow and any remaining fine debris travel in the direction of arrows 266 through the plurality of apertures 142 in the outer cylindrical portion 138 and towards the inlet 122 of the second stage separator 62 downstream the first stage separator 58. After the suction airflow and any debris travel through the plurality of apertures 142, the airflow and debris are directed around the cyclone axis 70 of the second stage separator 62 as represented by arrows 266. By cyclonic action, the debris is forced toward the sidewall 134 and the frustoconical portion 146 through the debris outlet 126 into the debris cavity 158.

Figure 8:
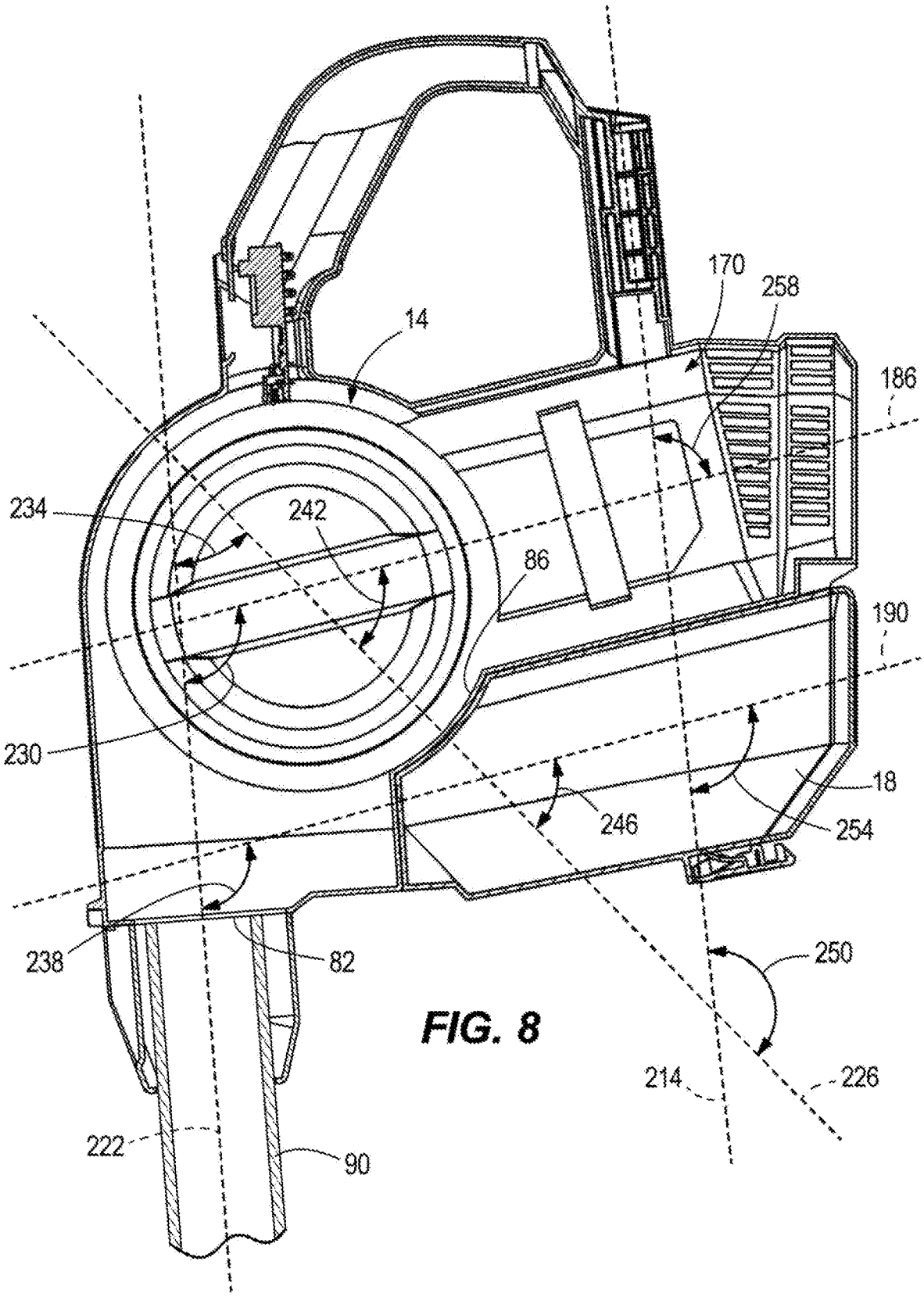
FIG. 8 is a partially isolated cross-sectional view about line 4-4 illustrating the relationship between the components of the vacuum cleaner of FIG. 1.

The debris falls along the outlet axis 226 (FIG. 8) into the debris collector 18. The relatively clean air travels out of the second stage separator 62 through the air outlet 130 as represented by arrow (e.g., a first direction) 270 in FIG. 5*b*. The airflow then travels through the filter 118, represented by arrow (e.g., a second direction) 274, to a channel 278. The channel 278 is in communication with the suction source 170, so the airflow travels through the fan 182 before being exhausted from the housing 22 through the exhaust 174.

Various features and advantages of the present subject matter are set forth in the claims.

The invention claimed is:

1. A handheld vacuum cleaner comprising;

a housing;

a handle extending from the housing;

a suction nozzle opening including an inlet axis that extends centrally through the suction nozzle opening;

a debris separator configured to separate debris from an airflow, the debris separator including an inlet having the inlet axis that extends centrally through the inlet and a debris outlet having an outlet axis that extends centrally through the debris outlet, the debris separator includes a generally horizontal cyclone having a cyclone axis that extends centrally through the generally horizontal cyclone, the airflow rotatable about the cyclone axis to separate the debris from the airflow, the cyclone axis being generally perpendicular to the inlet axis;

a suction source operable to generate the airflow, the suction source including a suction source axis, a motor, and a fan rotated by the motor about the suction source axis, the suction source axis extends centrally through the suction source and intersects the inlet axis and the generally horizontal cyclone, the suction source axis positioned at an obtuse angle relative to the inlet axis and perpendicular to the cyclone axis; and a debris collector in fluid communication with the debris outlet, the debris collector configured to receive the debris separated from the airflow, the debris collector extending below the suction source.

2. The handheld vacuum cleaner of claim 1, wherein the debris separator includes a first stage separator in fluid communication with the inlet and a second stage separator in fluid communication with the first stage separator.

3. The handheld vacuum cleaner of claim 2, wherein the first stage separator further comprises a sidewall that extends around the cyclone axis, wherein the inlet and the debris outlet extend through and are tangential to the sidewall.

4. The handheld vacuum cleaner of claim 3, wherein the second stage separator includes an outer cylindrical portion having a plurality of apertures to restrict large debris from entering the second stage separator, wherein the second stage separator includes a second stage debris outlet in fluid communication with the debris collector.

5. The handheld vacuum cleaner of claim 1, wherein the suction source axis is positioned at an acute angle relative to the outlet axis.

6. The handheld vacuum cleaner of claim 5, wherein the acute angle is in a range from 45 degrees to 70 degrees.

7. The handheld vacuum cleaner of claim 1, wherein the outlet axis is positioned at an acute angle relative to the inlet axis.

8. The handheld vacuum cleaner of claim 7, wherein the acute angle of the outlet axis relative to the inlet axis is in a range from 30 degrees to 60 degrees.

9. The handheld vacuum cleaner of claim 8, wherein the acute angle of the outlet axis relative to the inlet axis is in the range from 35 degrees to 45 degrees.

10. The handheld vacuum cleaner of claim 1, wherein the housing comprises a rear portion that forms a first substantially flat surface configured to support the handheld vacuum cleaner when the handheld vacuum cleaner is positioned on a surface, wherein the suction source is angled relative to the first substantially flat surface towards the inlet.

11. The handheld vacuum cleaner of claim 10, further comprising a battery connection port configured to be positioned at an angle relative to the surface that is configured to receive a battery for powering the suction source, wherein the battery, when received, is configured to be proximate to and offset the surface when the handheld vacuum cleaner is positioned on the surface to allow the battery to be removably coupled to the battery connection port.

12. The handheld vacuum cleaner of claim 10, wherein the debris collector includes a bottom wall positioned adjacent the first substantially flat surface of the housing, wherein the bottom wall aligns with the first substantially flat of the housing to support the handheld vacuum cleaner on the surface.

13. The handheld vacuum cleaner of claim 12, wherein the debris collector further comprises a release trigger configured to selectively open the bottom wall to allow debris to be removed from the debris collector.

14. The handheld vacuum cleaner of claim 1, further comprising a battery connection port that extends from the housing in a position between the debris separator and a rear portion of the housing, the battery connection port being configured to receive a battery along a battery connection axis for powering the suction source, and wherein the battery connection axis is offset and generally parallel to the inlet axis.

15. The handheld vacuum cleaner of claim 14, wherein the handle further comprises a first portion that extends from the housing proximate the debris separator and a second portion secured to the battery connection port.

16. The handheld vacuum cleaner of claim 1, wherein the debris collector extends along the housing adjacent to the suction source, wherein the generally horizontal cyclone proximate a front portion of the housing and in front of the debris collector and the suction source, and wherein the generally horizontal cyclone is positioned above the suction source and the debris collector when the handheld vacuum cleaner is positioned on a surface.

17. The handheld vacuum cleaner of claim 1, further comprising a filter in fluid communication with the generally horizontal cyclone, wherein the cyclone axis passes through the filter.

18. The handheld vacuum cleaner of claim 17, wherein the filter is annular and defines an aperture in communication with an air outlet of the generally horizontal cyclone, and wherein the airflow travels sequentially out the air outlet, through the aperture in a first direction, and through the filter in a second direction opposite the first direction prior to exiting the handheld vacuum.

19. The handheld vacuum cleaner of claim 17, further comprising a filter cover removably coupled to the housing to selectively secure the filter within the housing, wherein the cyclone axis passes through the filter cover.

20. A handheld vacuum cleaner comprising;

a housing;

a handle extending from the housing;

a suction nozzle opening including an inlet axis that extends centrally through the suction nozzle opening;

a debris separator configured to separate debris from an airflow, the debris separator including an inlet having the inlet axis that extends centrally through the inlet and a debris outlet having an outlet axis that extends centrally through the debris outlet, the debris separator includes a generally horizontal cyclone having a cyclone axis that extends centrally through the generally horizontal cyclone, the airflow rotatable about the cyclone axis to separate the debris from the airflow, the cyclone axis being generally perpendicular to the inlet axis;

a suction source operable to generate the airflow, the suction source including a suction source axis, a motor, and a fan rotated by the motor about the suction source axis, the suction source axis extends centrally through the suction source and intersects the inlet axis, the suction source axis positioned at an obtuse angle relative to the inlet axis and perpendicular to the cyclone axis;

a debris collector in fluid communication with the debris outlet, the debris collector configured to receive the debris separated from the airflow, the debris collector extending below the suction source; and a filter in fluid communication with the generally horizontal cyclone, wherein the cyclone axis passes through the filter, wherein the filter is annular and defines an aperture in communication with an air outlet of the generally horizontal cyclone, and wherein the airflow travels sequentially out the air outlet, through the aperture in a first direction, and through the filter in a second direction opposite the first direction prior to exiting the handheld vacuum.

* * * * *